United States Patent [19]

Gallagher

[11] Patent Number: 4,833,574

[45] Date of Patent: May 23, 1989

[54] ANNULAR FLUORESCENT LAMP

[76] Inventor: P. Christopher J. Gallagher, c/o Electronic Advanced Systems Corp., 5 Portland Rd., West Conshohocken, Pa. 19428

[21] Appl. No.: 166,662

[22] Filed: Mar. 11, 1988

[51] Int. Cl.[4] ..... F21S 5/00

[52] U.S. Cl. ..... 362/216; 362/260; 313/493

[58] Field of Search ..... 362/216, 260, 346; 313/493, 635, 612

[56] References Cited

U.S. PATENT DOCUMENTS

| | | | |
|---|---|---|---|
| 113,550 | 2/1939 | Clark | 362/217 |
| 1,870,147 | 8/1932 | Smally | 362/260 |
| 2,473,878 | 6/1949 | Greiner | 362/216 |
| 2,480,301 | 8/1949 | Moretz | 362/216 |
| 2,878,372 | 3/1959 | Fry | 362/216 |
| 3,899,712 | 8/1975 | Witting | 313/493 |
| 4,225,905 | 9/1980 | Moriyama et al. | 362/216 |
| 4,644,224 | 2/1987 | Saita et al. | 313/493 |

FOREIGN PATENT DOCUMENTS

| | | | |
|---|---|---|---|
| 1092839 | 4/1955 | France | 362/216 |
| 0102075 | 8/1979 | Japan | 362/216 |
| 702677 | 1/1954 | United Kingdom | 362/216 |
| 1368346 | 9/1974 | United Kingdom | 362/346 |

*Primary Examiner*—Ira S. Lazarus
*Assistant Examiner*—D. M. Cox
*Attorney, Agent, or Firm*—Howson & Howson

[57] ABSTRACT

Improved performance and compact size in an annular fluorescent lamp are achieved by providing two or more annular glass tube sections disposed one above another and connected to provide a single arc discharge path from a filament at one end of the lowermost tube section to a second filament at one end of the uppermost tube section. These multi-layer fluorescent lamps are particularly well suited for use in conjunction with internal reflectors, and with internal and external reflectors. The internal reflector may serve as a housing, or as part of a housing, for associated electrical components.

39 Claims, 8 Drawing Sheets

Fig. 3.
PRIOR ART
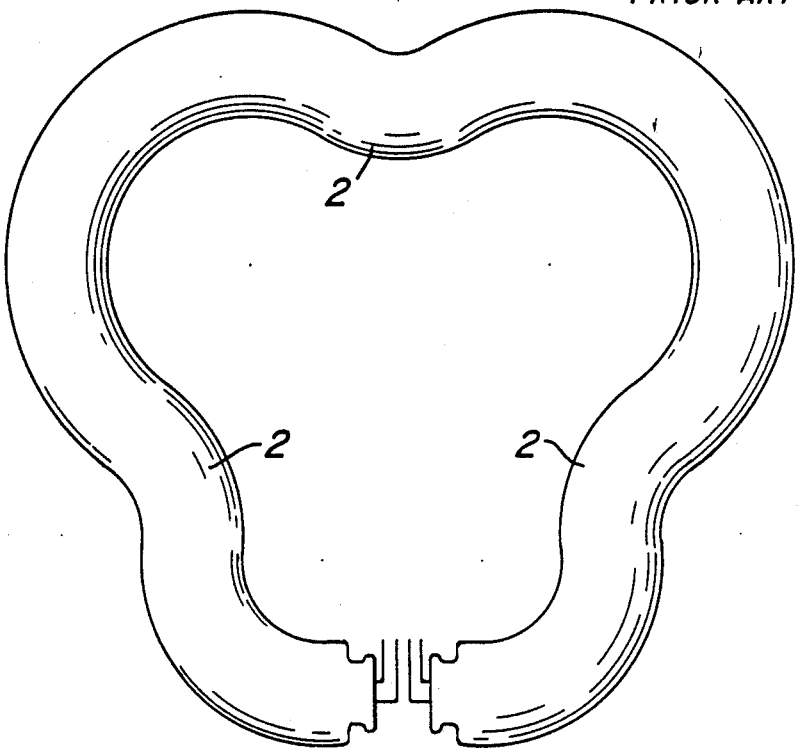
Fig. 4.
PRIOR ART
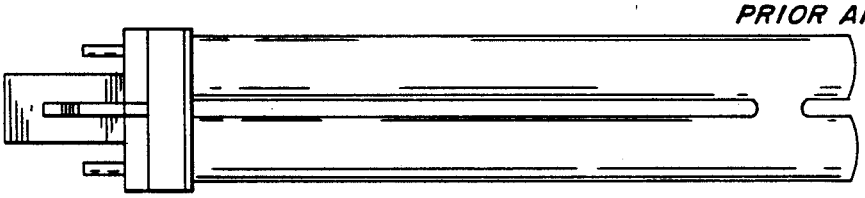
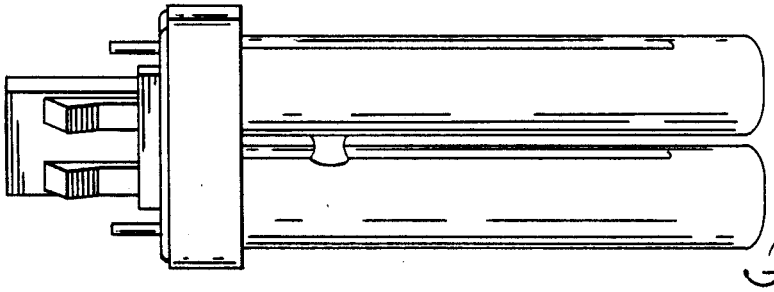
Fig. 5
PRIOR ART Fig. 8.
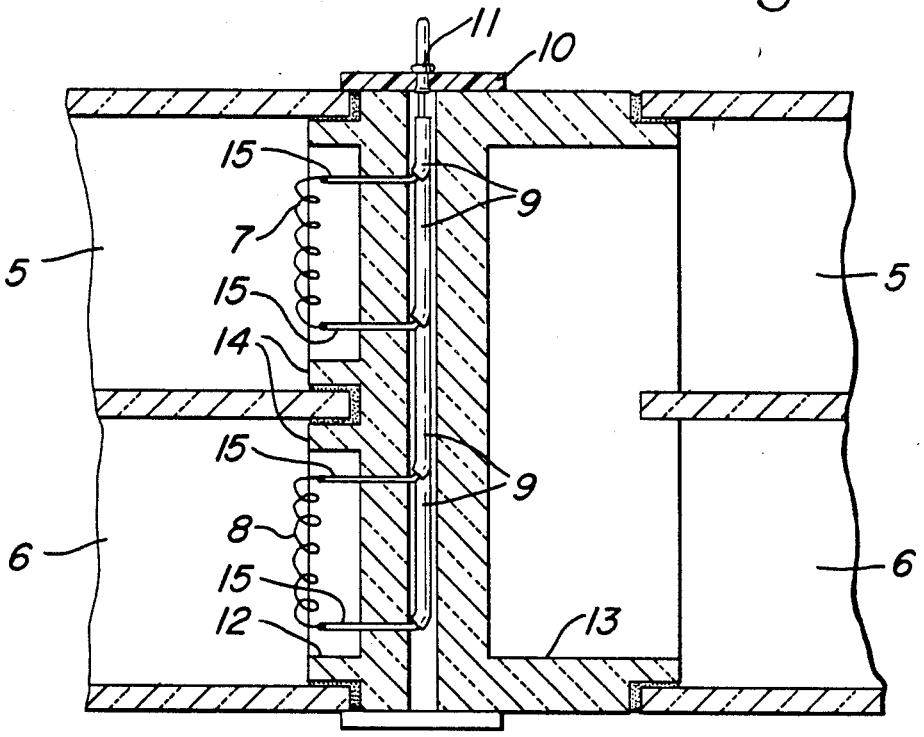
Fig. 10.
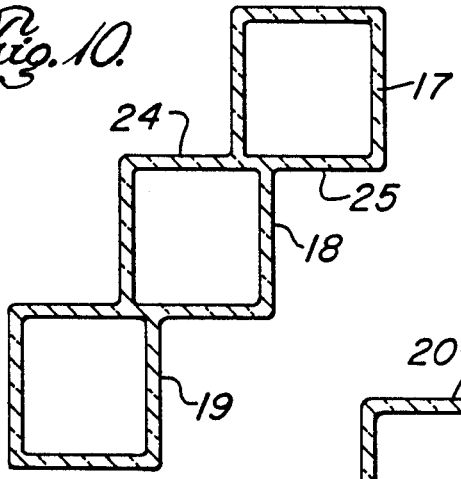
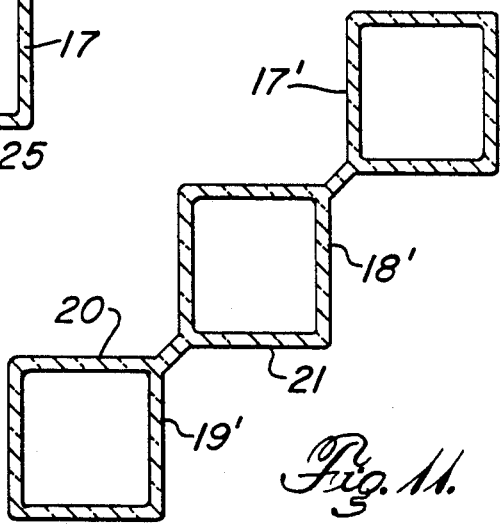
Fig. 11.

Fig. 12.
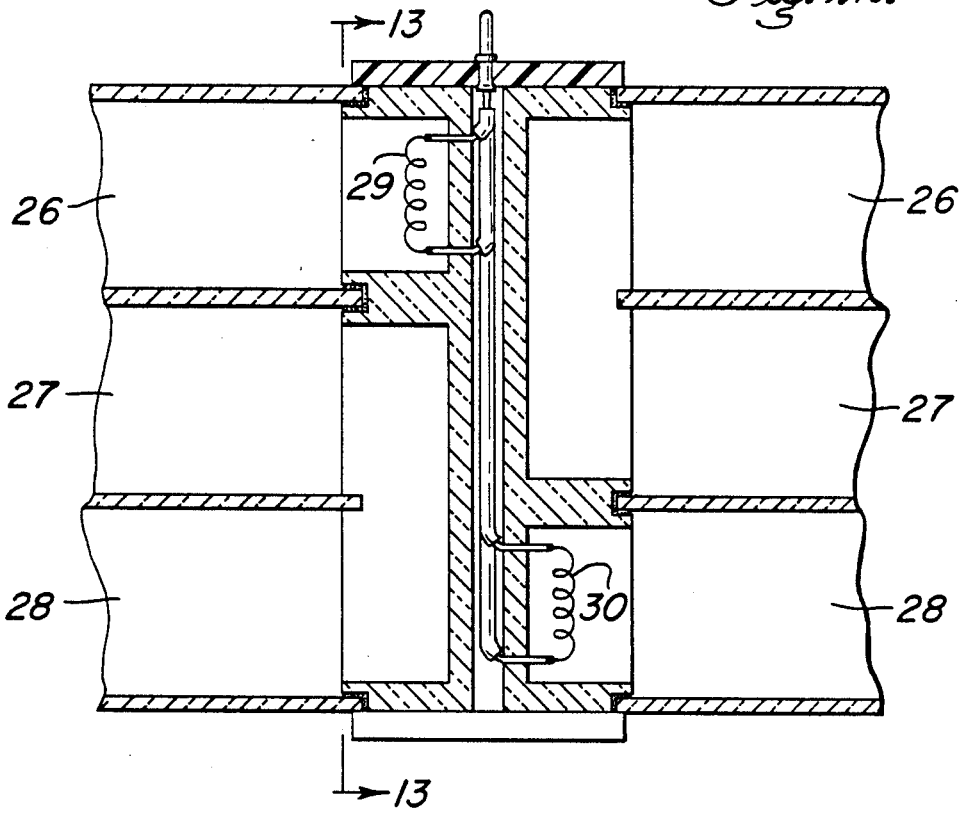
Fig. 9.
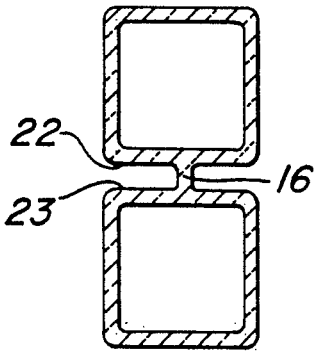
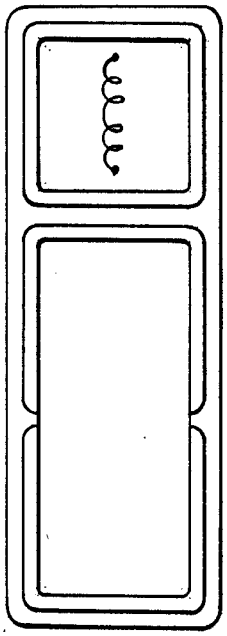
Fig. 13.

Fig. 14.
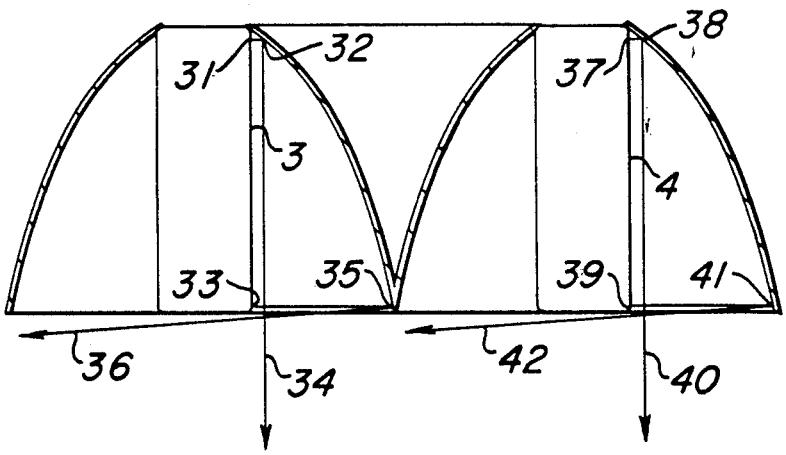
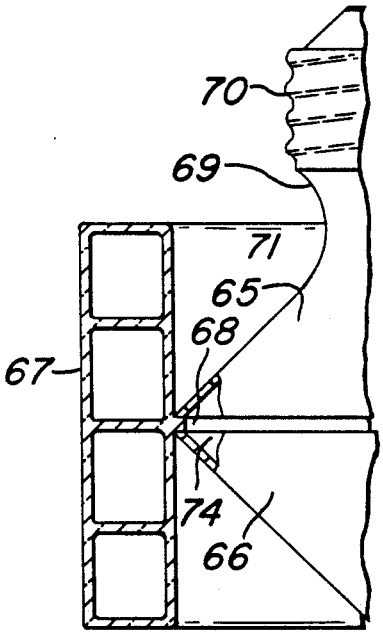
Fig. 17.
Fig. 18.
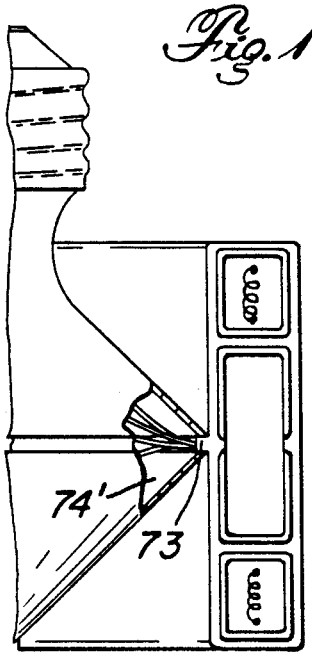

ANNULAR FLUORESCENT LAMP

BACKGROUND OF THE INVENTION

The present invention relates to an improvement in an electric discharge lamp used as a source of fluorescent illumination.

Fluorescent lamps have recently found increasing application as replacements for incandescent light bulbs (A-Lamps) and incandescent reflector lamps (R-Lamps) by reason of their five-fold greater luminous efficiency and much longer life. Several technical improvements have combined to yield fluorescent lamps with high light output which can fit within the confines of fixtures designed to accommodate incandescent light sources. Examples include the single-ended PL lamps of Philips Lighting in which the electric discharge is in 10 millimeter diameter glass tube formed into a tight U-shaped configuration, and the double twin single-ended lamps of GTE Sylvania in which 10 millimeter diameter glass tube is formed into a joined pair of tight U-shaped configurations. Further examples of the prior art are disclosed in U.S. Pat. Nos. 4,199,708 and 4,587,453, each comprising a joined pair of U-tubes.

Another design of compact fluorescent lamp, involving forming round section glass tube into a circular annulus, has long been available as a Circline® unit.- However, the lighting area of annular lamps is not efficient in comparison with the space occupied, as noted by Sugiyama et al. U.S. Pat. No. 3,191,087. Their size and shape does not often permit direct substitution for incandescent lamps in existing fixtures.

The length and cross-sectional area of the glass tube in which the electric discharge is confined are fundamental design parameters of a fluorescent lamp. The operting voltage and current of the lamp are largely determined by the length and area of the arc path. Other factors being equal, the shorter in length and larger in area the arc path, the lower the operating voltage and the higher the operating current of the lamp. The cross-section of the tube also has a strong effect on the luminous efficiency of the lamp. The narrower the tube, the better the coupling between the arc and the light-emitting phosphor coating on the inner surface of the tube, which tends to enhance the luminous efficiency of the lamp. Operation of an electric discharge lamp requires provision of current-limiting means. The long-established, low-cost method of current control is by series connection of a core-and-coil ballast. This method is most effective with lamps operating at no more than half of the supply voltage. Lamps designed for use on the 120 volt supply which is standard in the U.S.A. and in many other countries are often, accordingly, limited to a lamp voltage of 60 volts. This limitation serves to rule out for U.S. use with a core-and-coil ballast some designs of compact fluorescent lamp which have considerable utility but which operate at more than 60 volts across the lamp. Some relief of this design limitation is in sight, by employing solid state ballasts to control the electrical starting and operating conditions of fluorescent lamps, by which means the lamp can operate at a voltage higher than 50% of the voltage of the source of supply. However, solid state ballasts are at the present time more expensive and less reliable than core-and-coil ballasts.

In summary, presently available fluorescent lamps of annular, single U-shaped or double U-shaped configuration cannot in the majority of cases be directly substituted for incandescent light bulbs and reflector lamps in existing fixtures by reason of inappropriate shape, larger size per unit of light output and a lesser level of illumination than in many widely used incandescents.

SUMMARY OF THE INVENTION

One object of the present invention is to provide a fluorescent lamp with an improved configuration comprised of at least two vitreous tube sections, each formed into an annular configuration, and disposed one above the other, the tube sections being joined to form a single arc discharge path.

Another object of a preferred embodiment of the invention is a lamp occupying essentially annular cylindrical space, that is the space between two coaxial cylinders of different diameter, comprised of at least two tube sections formed into a circular annular configuration and disposed each one directly above the other.

A further object of the invention is that the size of the lamp be such that it will fit in a space comparable with that occupied by an incandescent light bulb or reflector lamp of like light output.

A yet further object is that preferred embodiments of the lamp shall emit light equivalent to incandescent lamps of at least 150 watts power consumption.

A still further object is that the light emitted from the inside and outside surfaces of the lamp shall be capable of being gathered and directed by means of suitably disposed reflective surfaces.

It is another object of preferred embodiments of the invention that the lamp may be placed in combination with its starting and current control means in such a way that the overall length and outside diameter of the assembly are increased over the dimensions of the lamp alone to a lesser degree than is the case for prior art lamps.

It is yet another object of the invention that preferred embodiments of the lamp shall operate at 60 volts thereby allowing current control to be by means of a core-and-coil ballast in the case of a 120 volt power supply.

It is a still further object of the invention that preferred embodiments of the lamp shall be of aesthetically pleasing appearance so that they may be used without need for an appearance-enhancing enclosure.

BRIEF DESCRIPTION OF THE DRAWINGS

FIG. 3 is a plan view of a lamp in the prior art having a non-circular annular configuration;

FIG. 4 is a side elevational view of a tight U-shaped compact fluorescent lamp in the prior art;

FIG. 5 is a side elevational view of a double twin compact fluorescent lamp in the prior art comprising a joined pair of tight U-shaped glass tubes;

FIG. 8 is a fragmentary sectional view of an embodiment of the lamp as seen through plane 8—8 in FIG. 6;

FIG. 9 is a schematic view showing the cross-section of tubes disposed according to an embodiment of the present invention;

FIG. 10 is a schematic view showing the cross-section of tubes disposed according to a further embodiment of the present invention;

FIG. 11 is a schematic view showing the cross-section of a modified version of the lamp of FIG. 10;

FIG. 12 is a fragmentary vertical section of a further embodiment of the lamp of the present invention;

FIG. 13 is an elevational view of the end cap used to close both ends of the sections of arc tube in FIG. 12;

FIG. 14 is a vertical section of an embodiment of the lamp of the present invention fitted with reflectors, with interior details of the lamp omitted;

FIG. 17 is a fragmentary vertical section showing a further embodiment of the fluorescent lamp assembly of the present invention, with interior details of the lamp omitted; and FIG. 18 is a fragmentary vertical section showing a modified version of the assembly of FIG. 17.

DESCRIPTION OF THE PRIOR ART

Figure 1:
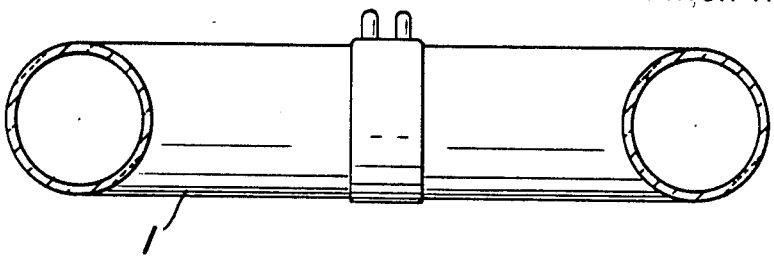
Fig. 1. PRIOR ART
FIG. 1 is a vertical section of a conventional annular fluorescent lamp as seen through plane 1—1 in FIG. 2.
Figure 2:
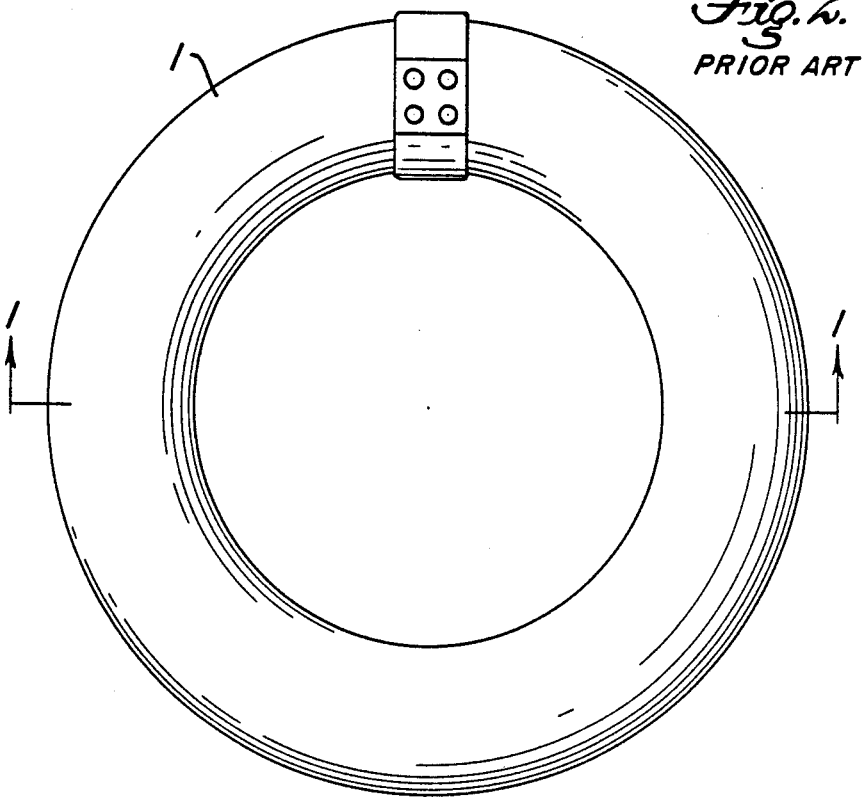
Fig. 2. PRIOR ART
FIG. 2 is a plan view of the lamp of FIG. 1.

FIGS. 1 and 2 illustrate an annular fluorescent lamp, long known in the prior art. The circular cross-section of the tube 1 comprising the lamp, the generally large (1.0 to 1.5 inch) diameter of the tube and the large diameter of the annulus represent a physical configuration which cannot readily be substituted for incandescent lamps. Commercially available annular lamps are typified by those manufactured by North American Philips. A 20 watt lamp, Model FC6T9, has an annulus inside diameter of 4.25 in., an outside diameter of 6.5 in. and a light output of 800 lumens. The 32 watt lamp, Model FC12T9, has an annulus inside diameter of 9.75 in., an outside diameter of 12 in. and a light output of 1800 lumens.

A recent attempt to improve the performance of an annular fluorescent lamp, the Model BFC21 from Panasonic, is illustrated in FIG. 3. The departures 2 from the standard circular annulus are designed for greater light output, achieved through increased coupling of the arc discharge with the phosphor coating on the tube interior. This 21 watt lamp has an annulus inside clearance diameter of 3 in., outside clearance diameter of 6.35 in. and light output of 900 lumens. The round section glass from which the lamp is formed has an outside diameter of 0.92 in. and the lamp operates at 60 volts with 0.35 amp current draw.

Illustrated in FIG. 4 is a PL compact fluorescent lamp, comprising 10 millimeter inside diameter tube formed into a tight U-shaped configuration, introduced to the U.S.A. in December, 1981 by North American Philips. A series of PL lamps is commercially available having the dimensions and specifications shown in Table 1.

TABLE 1

| Model | Illuminated Length | Overall Length | Lamp Power | Arc Path Length | Light Output (Lumens) |
|---|---|---|---|---|---|
| PL5 | 2.7 in. | 4.2 in. | 5 watts | 5.4 in. | 250 |
| PL7 | 3.8 in. | 5.3 in. | 7 watts | 7.6 in. | 400 |
| PL9 | 5.1 in. | 6.6 in. | 9 watts | 10.2 in. | 600 |
| PL13 | 5.9 in. | 7.4 in. | 13 watts | 11.8 in. | 900 |

For all lamps, the outside clearance diameter of the illuminated section is 1.1 in. and the arc path area is 0.12 sq. in.

The lamps yield 50 to 69 lumens per watt, compared with 10 to 15 lumens per watt for incandescents. High luminous efficiency is achieved by coating the tube interior with high performance phosphors and by the narrow diameter of the tube. The lamps all operate at 60 volts so that their current can be controlled easily and at low cost by a core-and-coil ballast.

Particularly for the PL9 and PL13, however, the overall length of the lamps is too great to permit direct substitution in the majority of fixtures for incandescent light bulbs and reflector lamps. A light bulb of up to 150 watt power rating has approximately a 2.5 in. diameter, illuminated length of 3.5 in. and overall length of 4.5 in. Reflector lamps in common use with up to 150 watt power rating are 3.75 to 5.0 in. outside diameter and 3.0 to 7.5 in. long.

A combination of physical size and power rating having greater utility ws achieved in 1985 with the compact fluorescent lamp illustrated in FIg. 5. Glass tube is formed into a joined pair of tight U-shaped configurations. The performance of a number of the resultant, so-called double-twin or quad, lamps which represent the present state-of-the-art in compact fluorescents is listed in Table 2.

TABLE 2

| Model | Illuminated Length | Overall Length | Lamp Power, Watts | Arc Length | Arc Area | Lamp Volts |
|---|---|---|---|---|---|---|
| GTE Sylvania F9DTT | 2.8 in. | 4.3 in. | 9 | 11.2 in. | .12 in$^2$ | 60 |
| GTE Sylvania F13DTT | 3.0 | 4.5 | 13 | 12.0 | .12 | 60 |
| Philips PLC 14 | 3.5 | 5.4 | 14 | 14.0 | .28 | 60 |
| Philips PLC 20 | 4.1 | 6.0 | 20 | 16.4 | .28 | 60 |
| Mitsubishi FDL18L | 3.8 | 5.0 | 18 | 15.2 | .28 | 60 |
| Mitsubishi FDL27L | 4.3 | 5.5 | 27 | 17.2 | .28 | 60 |
| Panasonic FDL28LED | 4.7 | 6.6 | 28 | 18.8 | .28 | 60 |
| Philips 10MM/18 | 5.1 | 6.3 | 18 | 20.4 | .12 | 90 |
| Philips 10MM/26 | 5.9 | 7.1 | 26 | 23.6 | .12 | 90 |

In comparison with the illuminated and overall length of a standard incandescent light bulb, the compact fluorescents of 9–14 watt power rating have like dimensions. The 18–28 watt compact fluorescents are up to 2.5 in. longer than a light bulb. The compact fluorescents of like size to a light bulb have light output up to the equivalent of a 75 watt incandescent, and the over-size compact fluorescents have light outputs up to that of a 100 watt incandescent.

Both the length and overall bulk of the state-of-the-art compact fluorescents limit their utility as the source of illumination for reflector units to be installed in existing fixtures. A 13 watt double-twin lamp is the largest fluorescent lamp which, when combined with a suitable reflector, will fit in the majority of existing recessed fixtures. It provides a broad beam of light, comparable to that from a 75 watt incandescent flood lamp.

DETAILED DESCRIPTION OF THE INVENTION

Figure 6:
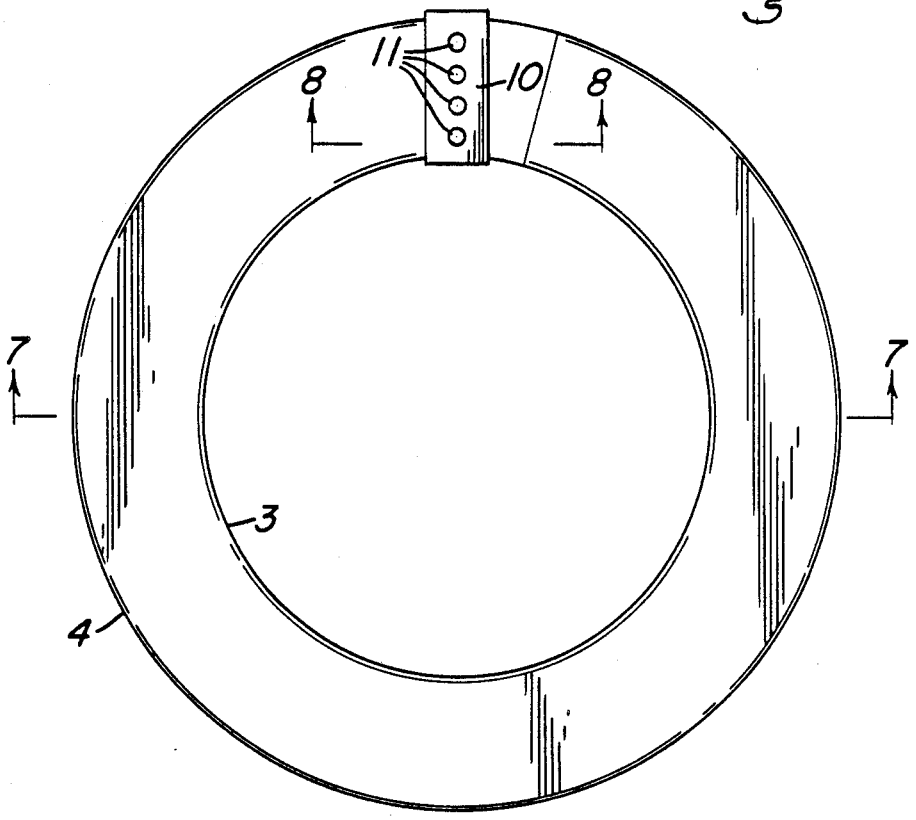
FIG. 6 is a plan view of an embodiment of the lamp of the present invention.
Figure 7:
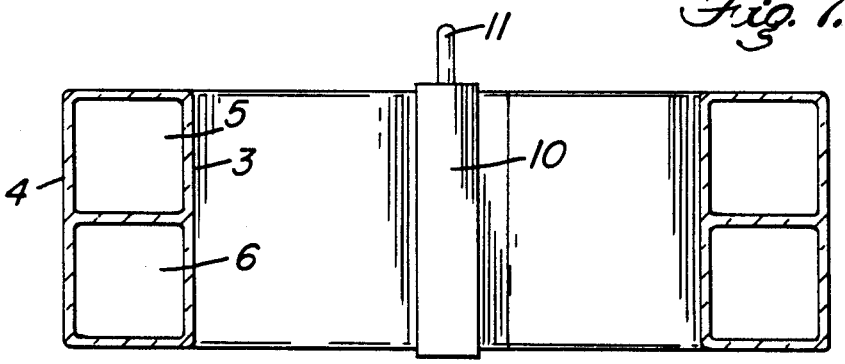
FIG. 7 is a vertical section of the lamp in FIG. 6 as seen through plane 7—7 in FIG. 6.

An embodiment of the lamp of the present invention is illustrated in FIGS. 6 and 7 and is listed as Example 1 in Table 3. The annular cylindrical configuration of this embodiment of the lamp has an inside surface 3 and outside surface 4. The arc is confined in substantially square section tubing 5 and 6 which is formed into a circular annular configuration. In this embodiment two sections of arc path are stacked one directly above the other. As illustrated schematically in FIG. 8, the discharge path describes an almost complete circle from one electrode 7 in section 5 of the tube, is transferred in the direction of the longitudinal axis of the lamp from one to the other section of the tube and describes an almost complete circle in section 6 of the tube of reach electrode 8. The wires 9 emerging from the electrode filaments are protected by an insulating cover 10 which can also serve as the support for electrical connection pins 11. The pins connect the lamp to the lamp starter and lamp current control means which can be as employed in the prior art.

The end caps 12 and 13 serve to close the tubes 5, 6 containing the arc path so that the lamp can be evacuated and back-filled with a discharge-sustaining medium as practiced in the prior art. In end cap 12, the protrusions 14 serve to isolate tube section 5 from tube section 6, while end cap 13 is configured so that the arc is continuous between tube sections 5 and 6. The glass tube sections 5 and 6 may conveniently be extruded in a single operation and subsequently be cut to length. The end caps may conveniently be molded from glass. The wire supports 15 for the filaments 7, 8 may be molded in place or be inserted later. A phosphor coating (not shown) may conveniently be applied to the glass interior surface prior to forming the tube sections into an annular configuration.

The dimensions of the lamp in Example 1, inside diameter 2.0 in., outside diameter 3.0 in. and length 1.0 in. with glass wall thickness approximately 0.025 in., are such that a light source of considerable utility is obtained. The interior dimensions of the tubes, square section of side 0.45 in. with rounded corners, provide an arc path area of 0.2 in$^2$. Two almost complete, joined circles of tube having mean annulus diameter of 2.5 in. provide an arc path length of approximately 15 in. Accordingly, the lamp will operate at 60 volts and its current can readily be controlled by a core-and-coil ballast. The lamp can be operated with a power input in the range 15–30 watts and can provide 1000–2000 or more lumens of light output.

TABLE 3

| Example | Tube Interior Size, in. | Number of, Mean Dia. of, Tube Circles | Lamp Inside Dia. | Lamp Outside Dia. | Lamp Length | Arc Length Arc Area |
|---|---|---|---|---|---|---|
| 1 | .45 × .45 | 2<br>2.5 in. | 2.0 | 3.0 | 1.0 in. | 15.0 in.<br>.2 in$^2$ |
| 2 | .55 × .55 | 2<br>3.1 in. | 2.5 | 3.7 | 1.2 in. | 19.0 in.<br>.3 in$^2$ |
| 3 | .6 in. dia. | 2<br>3.15 in. | 2.5 | 3.8 | 1.4 in. | 19.5 in.<br>.28 in$^2$ |
| 4 | .625 × .32<br>long wide | 2<br>2.75 in. | 2.4 | 3.1 | 1.3 in. | 16.0 in.<br>.2 in$^2$ |
| 5 | .45 × .45 | 3<br>3.0 in. | 2.5 | 3.5 | 1.5 in. | 27.0 in.<br>.2 in$^2$ |
| 6 | .55 × .55 | 3<br>2.5 in. | 1.9 | 3.1 | 1.8 in. | 23.0 in.<br>.3 in$^2$ |
| 7 | .60 × .60 | 3<br>4.75 in. | 4.0 | 5.5 | 2.0 in. | 40.0 in.<br>.35 in$^2$ |
| 8 | .60 × .50<br>long wide | 4<br>3.1 in. | 2.5 | 3.7 | 2.6 in. | 38.0 in.<br>.3 in$^2$ |
| 9 | .70 × .43<br>long wide | 3<br>2.625 in. | 2.125 | 3.125 | 2.24 in. | 24.0 in.<br>.3 in$^2$ |

Example 2 in Table 3 is a lamp with 0.3 in$^2$ and 19 in. arc path area and length respectively, virtually the same as for the Mitsubishi FDL27L and Panasonic FDL28LED lamps listed in Table 2. Accordingly, the three lamps have virtually identical electrical characteristics and light outputs. The lamp is Example 2 is 1.2 in. long, whereas the illuminated length of the prior art lamps cited is 4.3 in. and 4.7 in. respectively. While the lamp in Example 2 has outside diameter 3.7 in. and the prior art lamps both have outside clearance diameters less than 1.75 in., this difference does not diminish the utility of the lamp in Example 2 when employed for its design purpose, namely replacement of incandescent light bulbs and reflector lamps with outside diameter 2.5–5 in.

A further preferred embodiment, Example 3, is a lamp made of circular section tubing so formed that it occupies essentially the same annular cylindrical space as the lamp in Example 2. The electrical characteristics of the lamp of Example 3 are closely similar to those of Example 2, so that factors such as the operating temperature of the lamp, aesthetic appearance and the relative ease and cost of manufacture become involved in making a choice between them. The ratio of surface area to volume of the lamp of Example 3 is greater than for the lamp illustrated in FIG. 7. Accordingly, the lamp of Example 3 will better dissipate the heat which is generated during operation. Glass temperatures well in excess of 100° C. can arise when a fluorescent lamp is operated, as in many of the present examples, at 1–2 watts per inch of arc length. In a preferred embodiment of the present invention, the composition of the glass of the end cap 12 can be made especially heat resistant in view of its exposure to the heat generated at the lamp filaments. In general, the preferred composition of the glasses used in the present invention is that their most volatile constituents do not, during prolonged operation, contaminate the discharge-maintaining medium of the lamp.

FIG. 9 illustrates a further preferred embodiment of the present invention in which two substantially square section arc tube sections are separated by a bridge 16. In this way, a larger surface area is available to dissipate heat than in the lamp of FIG. 7.

FIGS. 10 and 11 illustrate in cross-section coaxial tube sections which are of different mean annular diameter. In FIG. 10, the mean annular diameters of tube sections 17 and 19 differ by less than a tube width from the mean annular diameter of tube section 18. In FIG. 11, the tube annular diameters of tube sections 17' and 19' differ by more than a tube width from the mean annular diameter of tube section 18'. In this way, a larger surface area is available to dissipate heat. A further advantage is that the light emitted from surfaces 20, 21 in FIG. 11 is not subject to physical interference as is the case for surfaces 22, 23 in FIG. 9 and is partially the case for surfaces 24, 25 in FIG. 10. The embodiments of FIGS. 10 and 11, while less compact than that of FIG. 7, have considerable utility, particularly for decorative use.

The arc tube sections, whether positioned relative to one another as in FIGS. 7, 9, 10 or 11, may be of any cross-section which has in particular application a preferred design function. In Example 4 the lamp is comprised of substantially rectangular section tube. In this preferred embodiment the longitudinal and transverse dimensions of the interior of the tube are 0.625 in. and 0.32 in. respectively. With glass of 0.025 in. wall thickness, the resultant lamp in the configuration of FIG. 7 is 1.3 in. long. A specific characteristic of this lamp, namely an inside diameter of the annulus approximately twice as great as the lamp length, has particular utility in applications where the light emitted from the inside surface 3 is reflected in a parallel, convergent or divergent beam so as to emerge from one end of the lamp. Lamps may be designed with rectangular section tubes in which the transverse inside dimension is considerably less than the 0.32 in. cited in Example 4, particularly if the lamp is allowed to function at greater than 60 volts.

FIG. 12 illustrates a further embodiment of the present invention in which three tube sections 26, 27, 28 of annular configuration are stacked one directly above the other. A filament 29 in tube 26 and a filament 30 in tube 28 are the points between which the arc discharge is maintained.

FIG. 13 illustrates an end cap, two of which when properly disposed may be used to enclose the ends of tube sections 26, 27, 28 so they are joined to form a single, continuous arc path. When the end cap is placed so that the filament in FIG. 13 corresponds to filament 29 in FIG. 12, tube 26 is locally isolated from tube 27 whereas the arc path passes without restriction between tube 27 and tube 28. When the end cap is placed so that the filament in FIG. 13 corresponds to filament 30 in FIG. 12, tube 28 is locally isolated from tube 27 whereas the arc can pass without restriction between tube 27 and tube 26.

Example 5 is similar to Example 1 but with three joined annular tube sections rather than two, and mean annulus diameter of 3.0 in. rather than 2.5 in. With an arc path of 27 in. it can be operated at well in excess of 30 watts which represents an extension beyond the present use range of commercially available compact fluorescent lamps. Its overall size, 2.5 in. inside diameter, 3.5 in. outside diameter and 1.5 in. length, is small enough to permit direct substitution for incandescents in most applications. With the lamp of Example 5 operating at 60 volts, and with the current in the range 500–600 milliamps, a light output of 2000–2500 lumens can be attained. With the lamp operating at from 90–120 volts and a current of 500–600 milliamps, light output of 2500–3000 lumens can be attained. At the highest power ratings, overheating can be ameliorated with tube sections disposed as in FIGS. 9, 10 or 11, leading to lamp dimensions somewhat different from those cited in Example 5. An advantage of the configuration of FIG. 12 is that the filaments 29, 30 where heat is concentrated during operation are separated by tube section 27 leading to a lesser tendency for end cap overheating.

Example 6 has the configuration shown in FIG. 12. This lamp is of particular utility as a source of illumination for a reflector lamp in the case where the reflector is required to have an outside diameter of 5 in. so that it will fit within a large proportion of existing recessed fixtures. For the light rays emitted from the interior cylindrical surface to emerge from one end of the lamp in a parallel beam in the direction of the lamp's longitudinal axis as a result of a single reflection, each must strike a reflective element positioned at 45° to said axis. Accordingly, a lamp annulus inside diameter of approximately twice the length of the lamp is required. If, however, the beam need not be parallel and it is only required that the light rays emitted from the interior cylindrical surface by means of a single reflection emerge from, rather than remain trapped within, the interior of the lamp then the angle of reflection need not be 45°. It has been determined, as illustrated in FIG. 14, that when the annulus inside diameter is approximately equal to the lamp length a suitably disposed reflector can, with no loss other than that caused by a single reflection, cause a divergent beam to emerge from the lamp interior.

A ray of light emitted from the top of the interior surface 3 of the lamp at point 31 will be reflected at an immediately adjacent point 32 by an element disposed at 45° to the lamp's longitudinal axis, will just clear the lowest point 33 of the lamp surface 3 and will emerge along the line 34. A ray of light emitted from point 33 will be reflected at point 35 by an element which is parallel to the longitudinal axis of the lamp and will emerge along line 36. The line between points 32 and 35, composed of the successive reflective elements positioned so that all reflected rays just clear point 33, when rotated 360° about the longitudinal axis of the lamp, generates a reflective surface which causes all of the rays emitted from the lamp surface 3 to emerge as a divergent beam of light. Similarly, reflective elements can be positioned to reflect rays emitted from the exterior surface 4 of the lamp. In a preferred embodiment, the ray from point 37 emerges along line 40 after striking the reflective element at point 38, the ray from point 39 emerges along line 42 after striking the reflective element at point 41 and the rays emitted from surface 4 between points 37, 39 emerge between lines 40, 42. In FIG. 14, the resultant curve between points 38 and 41 is identical to that between points 32 and 35. By rotating said curve between points 38 and 41 by 360° about the longitudinal axis of the lamp, a reflective surface is generated which causes all of the rays emitted by the lamp exterior surface 4 to emerge as a convergent beam of light. In the case of Example 6, the distance between points 35 and 41 is 2.5 in. so the reflector fluorescent lamp has a diameter of 5.0 in., small enough to fit in a large proportion of existing recessed fixtures. The reflective surfaces can conveniently be prepared by platinng, vacuum depositing or otherwise coating aluminum, chromium or other reflective material on the plastic moldings.

Figure 15:
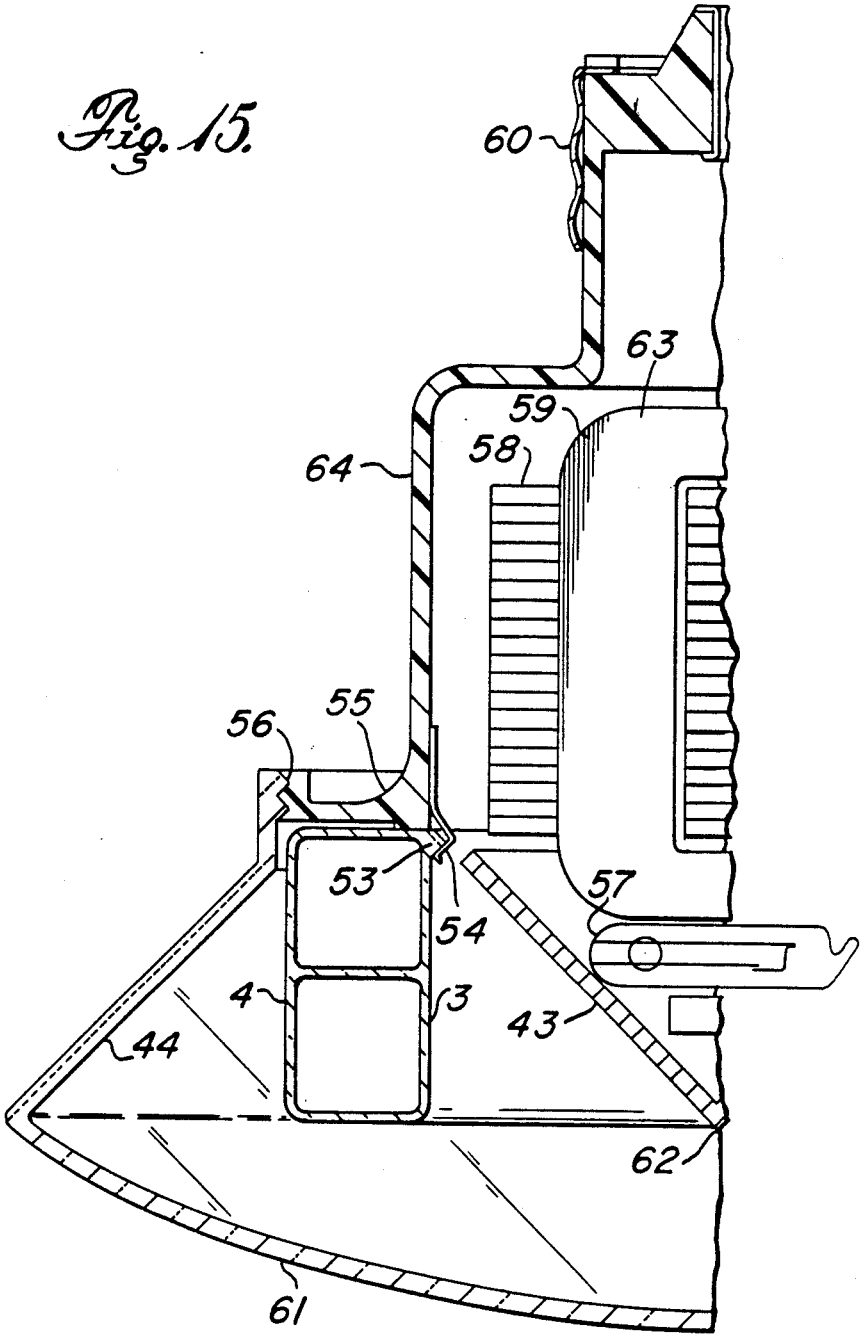
FIG. 15 is a fragmentary vertical section showing a fluorescent lamp assembly of the present invention.

FIG. 15 illustrates in section the lamp of Example 1, Table 3 mounted with interior and exterior reflectors 43 and 44 respectively, disposed at 45° to the longitudinal axis of the lamp so as to produce a beam of parallel light from the rays emitted by surfaces 3 and 4. With the reflective surfaces positioned at 45°, unit lengths of lamp surfaces 3, 4 will each require a reflector occupying a space 1.0 in. long and 1.0 in. wide. Accordingly, the dimensions of the lamp of Example 1 lead to a reflector fluorescent lamp unit with outside diameter 5.0 in. The lamp can be operated at 15–30 watts to provide a parallel beam of light having considerable utility. The lamp is provided with V-shaped protrusions 53 on its interior surface 3 at the innermost end so that it may be secured in its housing, for instance, by a multiplicity of spring clips 54. The protrusions may extend around the entire length of the tube, in which case the resultant rim may conveniently be formed integrally with the glass tube, for instance, by extrusion. A reusable reflector can be securely coupled to the upper housing 55 of the unit by engaging matching male and female screw threads 56.

Figure 16:
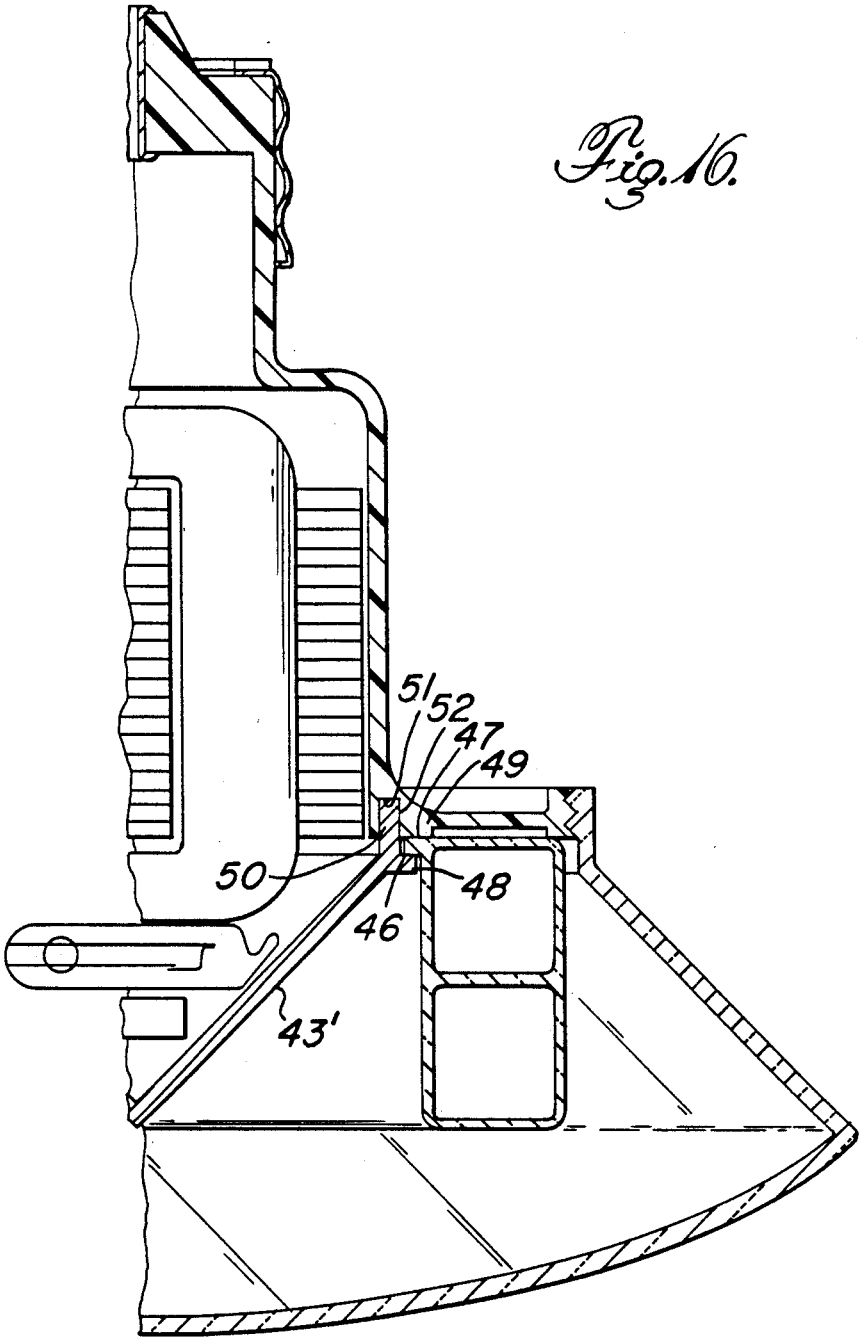
FIG. 16 is a fragmentary vertical section showing a modification of the assembly of FIG. 15.

Complete reflector fluorescent units fall in one of two basic categories, that in which the lamp is inseparably assembled with the reflector, starting and current control means and other components and the entire assembly is discarded when the lamp or another part fails, and that in which the lamp is replaceable and the reflector and other components are designed for extended use. The lamp shown in FIG. 16 is similar to the lamp of FIG. 15, but has a protrusion with lower surface 46 parallel to its upper surface 47 which can be securely held between two sections 48, 49 of the molded housing, for instance, by securing protrusions 50 in matching sockets 51, by means of adhesive 52. This mounting method is well-suited for a unit which is discarded when the lamp fails.

In both of the reflector fluorescent units of FIGS. 15 and 16, the space within the interior reflectors 43 and 43' is of considerable utility for complete or partial placement of the starting and current control means of the fluorescent lamp. The cone-shaped space depicted in FIG. 15, for example, can accept a standard glow bottle starter 57 and is able to house part of a standard, low-cost ballast comprised of a core of stacked steel E- and I-shaped laminations 58 and a multi-turn coil of wire wound on a spool 59. Connecting wires are not shown.

The space occupied by the steel core in a ballast used to control the current of a lamp in the power range under consideration is approximately 1.0 cubic inch per 10 watts of power throughput. Using laminations measuring 1.60 by 1.60 in., a stack 0.78 in. high will control the current to a lamp operating at 20 watts, and a stack 1.17 in. high will control a 30 watt lamp. The spool 59 protrudes typically 0.275 in. from each end of the stack of laminations. The method of making physical and electrical connection in a lampholder is typically by means of a male medium-base Edison threaded component 60 which is 1.25 in. long by 1 in. diameter. Allowing 0.75 in. axial clearance between the glass or plastic face plate 61 of the assembly and the tip 62 of the interior reflector, and clearance at the top of the ballast 63 for the passage of wires, a 30 watt reflector fluorescent lamp adapter assembly of approximately 4.5 in. overall length is obtained. The clearance diameter of the enclosure 64 for the ballast is approximately 2.5 in. An overall length for the unit of 3.75 in. is obtained in the case where the 30 watt unit is operated without the front face plate.

Solid-state ballasts for fluorescent lamp current control and starting are of much the same size at present as core-and-coil ballasts of equivalent power control capacity. However, progress is being made towards miniaturization. There is, accordingly, a reasonable near-term expectation that the space within the interior reflector 43 will be sufficient to house most or all of the solid state circuitry necessary to control a lamp of 30 watts or more power consumption. Said space is particularly well-suited in that it has little exposure to the heat generated by the lamp. Much of the heat generated by the lamp rises and, with the lamp operating in the common base-up or base-down positions, the space within the interior reflector 43 is not exposed to a significant degree to this convective heat transfer. Further, the highly reflective nature of the surface 43 in preferred embodiments serves to minimize the temperature rise associated with radiative heat transfer. Also, the physical connections between the interior space and the lamp are limited so that little heat will enter the ballast enclosure by conduction.

Larger diameter lamps may be designed according to the present invention in which a substantial part of a standard core-and-coil ballast will fit inside the space within the interior reflector 43. For instance, the lamp of Example 7, Table 3, comprised of glass with 0.050 in. wall thickness, is designed to operate at 40 watts. Its current can be controlled by a ballast with a laminated core occupying 4 cubic inches. A suitable configuration for the ballast core is laminations each 2 in. by 2 in. stacked 1.0 in. high, with the spool protruding a further 0.35 in. at each end. The ballast thus measures 1.7 in. high overall and it is found that 0.7 in. of this height can reside within the reflector 43. The resultant 40 watt reflector fluorescent adapter assembly, capable of producing over 3000 lumens of light, is 5.0 in. long and has a maximum diameter of 9.5 in.

An adapter assembly designed to replace an incandescent light bulb can incorporate the lamp of Example 8, comprised of glass with 0.04 in. wall thickness and, in a preferred embodiment, can be assembled as in FIG. 17. Surfaces 65 and 66, of high specular reflectivity, can be disposed at angles chosen by the designer to yield rays emerging along convergent, parallel or divergent paths from within the annular lamp. In an alternative embodiment, one or both surfaces 65, 66 can be of smooth, white plastic with a high coefficient for diffuse reflectivity.

The lamp 67 comprises four joined annular tube sections providing an arc path of length 38 in. and area 0.3 $in^2$. It incorporates a series of protrusions 68 which, when held between the upper and lower reflective housings, provides a secure mounting means for the lamp. The plastic stem 69 to which the electrical coupling 70 is attached can conveniently be molded integrally with the upper reflective housing. The neck 71 of the housing can be designed to provide useful light output from its specular or diffuse reflective surface while at the same time providing an aesthetically pleasing and secure connection between the lamp and the source of electrical power.

As shown in FIG. 18, in the case of an adapter assembly in which the lamp is not replaceable, the wires from the lamp filaments can pass through a small aperture 73 between the upper and lower housings and be connected directly to the starter, ballast and source of electrical power, which are not shown in FIG. 18. In cases where the lamp is replaceable, the lamp may conveniently be held in place by spring clips, as shown in FIG. 14, and electrical contact may be made to the lamp filaments following the method disclosed by Metoff, U.S. Pat. No. 4,278,911.

The spaces 74 and 74' within the upper and lower housings in FIGS. 17 and 18 are of considerable utility for placement of the starting and current control means of the lamp. In order to achieve the configuration depicted in FIGS. 17 and 18, it is necessary that the spaces 74 and 74' be sufficient to accomodate all of the required electrical components. In the embodiment of FIG. 17, where surfaces 65 and 66 are separated only by narrow protrusions 68, the configuration of the space 74 is essentially back-to-back cones which is reasonably well-adapted to accept a standard core-and-coil ballast. The interior space 74 of the lamp of Example 8 can hold a ballast with laminations 1.5 in. square stacked to a height of 0.5 in. That is, the space occupied by the laminations is 1.125 $in^3$ and a lamp of approximately 11.25 watts can be satisfactorily controlled.

To accommodate a taller stack of ballast laminations, and thereby have the means to control a lamp operating at higher wattage, the upper housing can be separated from the lower housing along the longitudinal axis of the lamp to create an interior space in which two cones are separated by a cylinder with the same base dimensions. Separating the upper and lower housings by 0.5 in. increases the interior space 74 of the lamp of Example 8 so that it can hold a ballast with laminations 1.5 in. square stacked to a height of 1.0 in. enabling a 22.5 watt lamp to be controlled. Further separating the upper and lower housings to a total of 1.0 in. enables a ballast with a stack of 1.5 in. square laminations, 1.375 in. high occupying a space of 3.1 $in^3$, to be placed in space 74, whereby a lamp drawing approximately 31 watts may be operated.

In an alternative preferred embodiment, the lamp tube sections can be bent so that the lamp is four-sided rather than circular. This configuration leads to a space 74 comprised of two back-to-back four-sided pyramids. Particularly in the case where the upper and lower housings are separated along the longitudinal axis, the space 74 is excellently adapted to contain a standard core-and-coil ballast.

The space 74 within the lamp of Example 8 as depicted in FIG. 17 is approximately 6 $in^3$. A solid-state ballast, comprised as it is of discrete electronic components mounted on one or more circuit boards, can usually be designed to fit well within whatever shaped space is available. It is estimated that 50 to 75% of the volume of the pair of back-to-back cones can be used to good effect, that is a 3.0 to 4.5 $in^3$ ballast can be installed within a volume of 6 $in^3$, able to control a 30 to 45 watt lamp.

The dimensions of the lamp of Example 9 are such that its interior space 74 in a double-cone configuration is 4 $in^3$ which, when 75% utilized, can hold a solid-state ballast capable of controlling 30 watts. the resultant lamp, made of glass with 0.035 in. wall thickness, is of considerable utility in replacing a 100 watt incandescent light bulb. Its size, 2.24 in. illuminated length, approximately 3.5 in. overall length and 3.125 in. outside diameter, enables it to fit in almost all lampholders which accept a 100 watt light bulb. Its arc length and area, approximately 24 in. and 0.3 $in^2$ respectively, enable it to operate at 30 or more watts. The lamp will operate at 60 volts which is of considerable utility where there is a 120 volt power supply.

While the invention has been illustrated and described in different embodiments, it is recognized that other variations and changes may be made therein without departing from the invention, as set forth in the claims.

I claim:

1. A fluorescent lamp comprised of at least two glass tube sections, each formed into a loop with the ends thereof being in close proximity to each other, the loops being substantially coaxial, and said tube sections disposed with their respective centerlines substantially in separate parallel planes, the interior surfaces of said tube sections being coated with a fluorescent material, and said tube sections containing a discharge-sustaining medium, means providing a connecting section having a tubular internal passage, said passage extending from each of said tube sections to each next adjacent tube section and the ends of said passage being connected to ends of the respective tube sections so that all of said tube sections are connected in series to form a single tubular arc discharge path, and electrodes placed at opposite ends of the path, said lamp operating by the passage of current between said electrodes through said medium.

2. The fluorescent lamp of claim 1 in which each of at least two of said tube sections is formed into a circular annular configuration, and said circular annular tube sections are disposed one directly above the other thereby occupying essentially the space between two imaginary coaxial cylinders of different diameter.

3. The fluorescent lamp of claim 1 in which each of at least two of said tube sections is formed into a substantially four-sided annular configuration, said four-sided tube sections being disposed one directly above the other.

4. The fluorescent lamp of claim 1 in which the tube sections are of substantially square cross-section.

5. The fluorescent lamp of claim 4 in which each tube section immediately adjacent to another shares with it a common wall.

6. The fluorescent lamp of claim 5 in which substantially all glass surfaces of the tube sections exposed to air are substantially smooth and uninterrupted.

7. The fluorescent lamp of claim 1 in which the tube sections are of circular cross-section.

8. The fluorescent lamp of claim 1 in which the tube sections are of substantially rectangular cross-section.

9. The fluorescent lamp of claim 8 in which each tube section immediately adjacent to another shares with it a common wall.

10. The fluorescent lamp of claim 9 in which substantially all glass surfaces of the tube sections exposed to air are substantially smooth and uninterrupted.

11. The fluorescent lamp of claim 1 in which each tube section immediately adjacent to another is separated therefrom for at least a major part of its length by an air gap.

12. The fluorescent lamp of claim 1 in which adjacent tube sections are held a fixed distance from each other and joined to each other by means of at least one bridge of vitreous material.

13. The fluorescent lamp of claim 1 in which the mean radial distance from the axis of one of said tube sections to the centerline thereof is different from the corresponding mean radial distance for another of said tube sections.

14. A fluorescent lamp assembly comprising:

(a) a fluorescent lamp comprised of at least two glass tube sections, each formed into a loop with the ends thereof being in close proximity to each other, the loops being substantially coaxial, and said tube sections disposed with their respective centerlines substantially in separate parallel planes, the interior surfaces of said tube sections being coated with a fluorescent material, and said tube sections containing a discharge-sustaining medium, means providing a connecting section having a tubular internal passage, said passage extending from each of said tube sections to each next adjacent tube section and the ends of said passage being connected to ends of the respective tube sections so that all of said tube sections are connected in series to form a single tubular arc discharge path and electrodes placed at opposite ends of the path, said lamp operating by the passage of current between said electrodes through said medium;

(b) current control and starting means and associated wiring electrically connected to said electrodes;

(c) a housing to support said lamp and to enclose said current control and starting means and associated wiring;

(d) a means for electrically and physically connecting said lamp assembly in a lighting fixture.

15. The assembly of claim 14 in which at least part of the housing upon which the light output of the lamp impinges has a highly reflective surface whereby the light emerges with little loss.

16. The assembly of claim 14 in which at least part of the housing is disposed within at least one of the loops and configured so as to reflect at least part of the light emitted radially inwards by said lamp so that said light emerges from one end of said lamp.

17. The assembly of claim 16 in which at least part of the housing upon which the light output of the lamp impinges has a highly reflective surface whereby the light emerges with little loss.

18. The assembly of claim 16 in which that part of the housing disposed within at least one of said loops is essentially cone-shaped.

19. The assembly of claim 18 in which at least part of the housing upon which the light output of the lamp impinges has a highly reflective surface whereby the light emerges with little loss.

20. The assembly of claim 14 in which at least part of the housing is disposed within at least one of the loops and said part of the housing contains within it at least part of the current control and starting means and associated wiring for said lamp.

21. The assembly of claim 20 in which at least part of the housing upon which the light output of the lamp impinges has a highly reflective surface whereby the light emerges with little loss.

22. The assembly of claim 14 in which at least part of the housing is disposed within at lest one of the loops and said part of the housing is comprised of two essentially cone-shaped sections positioned to reflect at least part of the light emitted radially inwards by said lamp so that said light emerges from both ends of said lamp.

23. The assembly of claim 22 in which at least part of the housing upon which the light output of the lamp impinges has a highly reflective surface whereby the light emerges with little loss.

24. The assembly of claim 14 in which at least part of the housing is disposed at least partly within said loops and said part of the housing contains essentially all of the current control and starting means and associated wiring for said lamp.

25. The assembly of claim 24 in which at least part of the housing upon which the light output of the lamp impinges has a highly reflective surface whereby the light emerges with little loss.

26. The assembly of claim 14 in which at least part of the housing is disposed without said lamp and said part of the housing is configured so as to reflect at least part of the light emitted radially outwards by said lamp so that said light emerges at one end of the said lamp.

27. The assembly of claim 26 in which at least part of the housing upon which the light output of the lamp impinges has a highly reflective surface whereby the light emerges with little loss.

28. The fluorescent lamp assembly of claim 14 in which the lamp is furnished with at least one protrusion from a surface exposed to air, said protrusion captured between opposing surfaces of the housing whereby compressive force is applied and said lamp is secured in said housing.

29. The fluorescent lamp assembly of claim 14 in which the lamp is furnished with at least one protrusion from a surface exposed to air which slidingly engages and disengages with at least one mating surface of the housing, whereby said lamp is respectively secured within and removed from said housing.

30. The assembly of claim 14 in which at least part of the light emitted radially inwards by said lamp emerges from one end of said lamp after a single reflection from a surface of the housing within said lamp and in which at least part of the light emitted radially outwards by said lamp emerges at the same end of said lamp after a single reflection from a surface of the housing without said lamp and that at least part of the light passes through a face plate placed a suitable clearance distance from the said end of said lamp.

31. The assembly of claim 30 in which the face plate is comprised of glass.

32. The assembly of claim 30 in which the face plate is comprised of plastic.

33. The assembly of claim 30 in which the face plate is comprised of cells between which the light passes without obstruction.

34. The assembly of claim 30 in which said housing without the lamp and said face plate are integral and are fitted with securing means whereby they may be repeatedly secured in place about said lamp and repeatedly removed therefrom, whereby access to said lamp for replacement may be achieved.

35. The assembly of claim 34 in which said securing means comprise matching male and female screw threads.

36. The assembly of claim 30 in which said face plate is fited with securing means whereby it may be repeatedly securely attached to said housing and repeatedly removed therefrom, whereby access to said lamp for replacement may be achieved.

37. The assembly of claim 36 in which said securing means comprise matching male and female screw threads.

38. A fluorescent lamp having a continuous tubular discharge path comprising multiple substantially coaxial loop-shaped sections disposed with their respective centerlines substantially in separate parallel planes, both ends of each loop-shaped section being in close proximity to each other, and each loop-shaped section being connected to each adjacent loop-shaped section by a connecting section having a tubular internal passage, said passage extending from one loop-shaped section to the other and the ends of said passage being connected to ends of the respective loop-shaped sections so that the loop-shaped sections are connected in series to form said continuous tubular discharge path.

39. A fluorescent lamp having a continuous tubular gas discharge path comprising:

multiple tube sections each in the form of a loop, the loops being substantially coaxial and having their centerlines disposed substantially in separate parallel planes;

end cap means extending substantially perpendicular to said planes, each of said tube sections being connected to the end cap means and extending in a loop from one side of the end cap means to the other;

the structure comprising the tube sections and the end cap means having internal passage means providing gas communication between said tube sections whereby said tube sections are interconnected in series to provide said continuous tubular discharge path;

electrode means at the opposite ends of said continuous discharge path, electrical terminal means on said end cap means, and conductive means connected through said end cap means for conducting current to said electrode means from said electrical terminal means.

* * * * *